US007591152B2

(12) United States Patent
Hu

(10) Patent No.: US 7,591,152 B2
(45) Date of Patent: Sep. 22, 2009

(54) DOUBLE BEVEL TYPE DOUBLE-KNIT CIRCULAR KNITTING MACHINE

(76) Inventor: Ching-Sung Hu, No.10, Alley 81, Lane 215, Jinmen St., Banciao City, Taipei County 220 (TW)

( * ) Notice: Subject to any disclaimer, the term of this patent is extended or adjusted under 35 U.S.C. 154(b) by 0 days.

(21) Appl. No.: 12/196,351

(22) Filed: Aug. 22, 2008

(65) Prior Publication Data

US 2009/0151396 A1 Jun. 18, 2009

(30) Foreign Application Priority Data

Aug. 23, 2007 (TW) ..... 96131182 A

(51) Int. Cl.
*D04B 9/10* (2006.01)

(52) U.S. Cl. ..... 66/17

(58) Field of Classification Search ..... 66/8, 66/17, 18, 19, 64
See application file for complete search history.

(56) References Cited

U.S. PATENT DOCUMENTS 525,661 A * 9/1894 Lacaisne ..... 66/9 R
539,819 A * 5/1895 Nye ..... 66/17
729,074 A * 5/1903 Lasher ..... 66/17
2,202,824 A * 6/1940 Boulais ..... 66/17
3,531,951 A * 10/1970 Doughty ..... 66/14
3,832,867 A * 9/1974 Luchi ..... 66/9 R
3,961,498 A * 6/1976 Braunschweiler ..... 66/13

* cited by examiner

*Primary Examiner*—Danny Worrell
(74) *Attorney, Agent, or Firm*—Guice Patents PLLC

(57) ABSTRACT

A double bevel type double-knit circular knitting machine includes an inner annular needle cylinder holder and an outer annular needle cylinder holder configured to show a double bevel profile, and inner base member and an outer base member respectively affixed to the inner annular needle cylinder holder and the outer annular needle cylinder holder to hold sector-shaped inner cam adjustment members and outer cam adjustment members respectively, inner cam blocks and outer cam blocks respectively affixed to the inner base member and the outer base member, and inner and outer needles respectively arranged between the inner annular needle cylinder holder and the inner cam blocks and between the outer annular needle cylinder holder and the outer cam blocks and reciprocating in respective needle tracks in the inner cam blocks and the outer cam blocks to perform a knitting process.

8 Claims, 12 Drawing Sheets

DOUBLE BEVEL TYPE DOUBLE-KNIT CIRCULAR KNITTING MACHINE

BACKGROUND OF THE INVENTION

1. Field of the Invention

The present invention relates to a circular knitting machine and more particularly, to a double bevel type double-knit circular knitting machine, which has an inner annular needle cylinder holder and an outer annular needle cylinder holder configured to show a 50°~60° double bevel profile. Further, a sinker may be coupled to the inner needles or the outer needles of the double bevel type double-knit circular knitting machine to assist in holding down the knitted fabric, for enabling the double bevel type double-knit circular knitting machine to knit double knit fabrics as well as double-faced reversible fabrics and double-faced irregular shaped fabrics.

2. Description of the Related Art

A conventional double knit circular knitting machine generally comprises a disc having a horizontal needle cylinder holder and a vertical needle cylinder holder, a plurality of sector-shaped horizontal cam adjustment members horizontally abutted against one another along the surface of the horizontal needle cylinder holder, a plurality of horizontal cam blocks respectively arranged at the bottom side of the sector-shaped horizontal cam adjustment members, a plurality of horizontal needles reciprocatable in a respective horizontal needle track in each of the horizontal cam blocks to perform a knitting process; a plurality of sector-shaped vertical cam adjustment members abutted against one another along the surface of the vertical needle cylinder holder, a plurality of vertical cam blocks respectively arranged at the bottom side of the sector-shaped vertical cam adjustment members, and a plurality of vertical needles reciprocatable in a respective vertical needle track in each of the vertical cam blocks to perform a knitting process. During reciprocating motion of the horizontal needles and the vertical needles, yarns feeding from a yarn feeder above the disc are knitted into a fabric.

The aforesaid conventional double knit circular knitting machine is still not satisfactory in function. Because the horizontal needles and the vertical needles are reciprocating in different directions during a knitting operation, the effect of force distribution may result in uneven loop lengths or escape of loops. The knitted fabric has low elasticity. Further, this design of double knit circular knitting machine is practical for knitting double-faced reversible fabrics, double-faced irregular shaped fabrics, or fine gauge fabrics (20 G/inch or 24 G/inch).

Therefore, it is desirable to provide a double knit circular knitting machine that eliminates the aforesaid drawbacks.

SUMMARY OF THE INVENTION

The present invention has been accomplished under the circumstances in view. It is therefore the main object of the present invention to provide a double bevel type double-knit circular knitting machine that eliminates the drawbacks of the conventional double knit circular knitting machines.

According to one aspect of the present invention, the double bevel type double-knit circular knitting machine comprises an inner annular needle cylinder holder and an outer annular needle cylinder holder extending around the inner annular needle cylinder holder. The inner annular needle cylinder holder and the outer annular needle cylinder holder slope in two reversed directions at a same sloping angle, for example, 50°~60°, to show a double bevel profile. Further, a sinker may be coupled to the inner needles or the outer needles to assist in holding down the knitted fabric. Therefore, the double bevel type double-knit circular knitting machine is practical for knitting double knit fabrics as well as double-faced reversible fabrics and double-faced irregular shaped fabrics.

According to the preferred embodiment of the present invention, the double bevel type double-knit circular knitting machine comprises a disc, the disc comprising an inner annular needle cylinder holder and an outer annular needle cylinder holder extending around the inner annular needle cylinder holder, the inner annular needle cylinder holder and the outer annular needle cylinder holder sloping in two reversed directions at a same sloping angle to show a double bevel profile; an inner base member fixedly mounted on an inner side of the inner annular needle cylinder holder; a plurality of sector-shaped inner cam adjustment members fixedly mounted on a top side of the inner base member and abutted against one another along an inner surface of the inner annular needle cylinder holder; a plurality of inner cam blocks respectively provided at a bottom side of each of the sector-shaped inner cam adjustment members, the inner cam blocks each defining a respective needle track; a plurality of inner needles respectively arranged between the inner annular needle cylinder holder and the inner cam blocks and reciprocatable in the needle tracks of the inner cam blocks to perform a knitting process; an outer base member fixedly mounted on an outer side of the outer annular needle cylinder holder; a plurality of sector-shaped outer cam adjustment members fixedly mounted on a top side of the outer base member and abutted against one another along an outer surface of the outer annular needle cylinder holder; a plurality of outer cam blocks respectively provided at a bottom side of each of the sector-shaped outer cam adjustment members, the outer cam blocks each defining a respective needle track; and a plurality of outer needles respectively arranged between the outer annular needle cylinder holder and the outer cam blocks and reciprocatable in the needle tracks of the outer cam blocks to perform a knitting process. Because the inner annular needle cylinder holder and the outer annular needle cylinder holder slope in two reversed directions at a same sloping angle to show a double bevel profile, the invention facilitates tuck and withdrawal operation of the needles to knit a fabric having better elasticity, evenness, tightness, and solidity.

Further, the sloping angle of the inner annular needle cylinder holder and the outer annular needle cylinder holder is preferably at 50°~60°, or most preferably at 55°.

DETAILED DESCRIPTION OF THE PREFERRED EMBODIMENT

Figure 1:
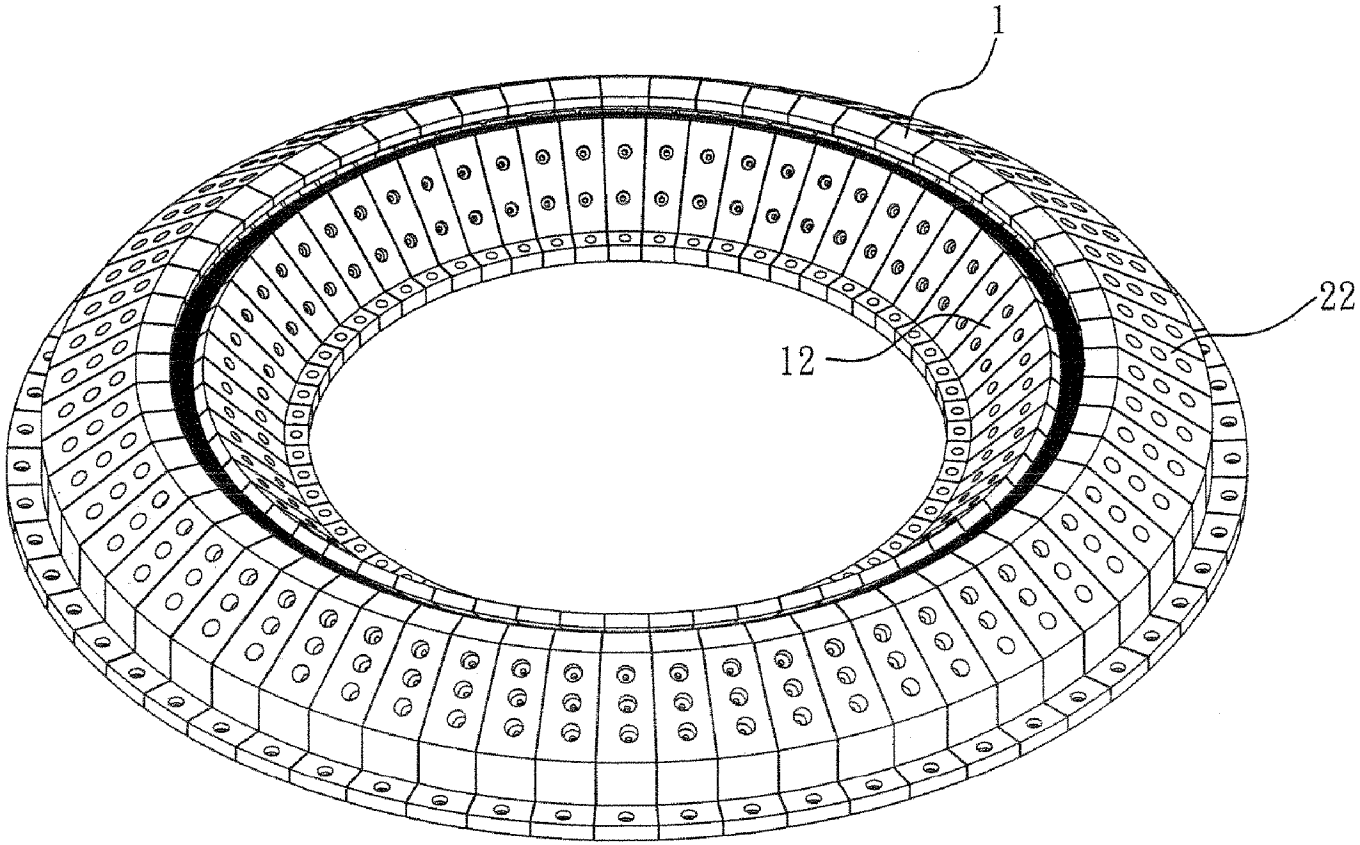
FIG. 1 is an elevational view of a disc of a double bevel type double-knit circular knitting machine in accordance with the present invention.
Figure 2:
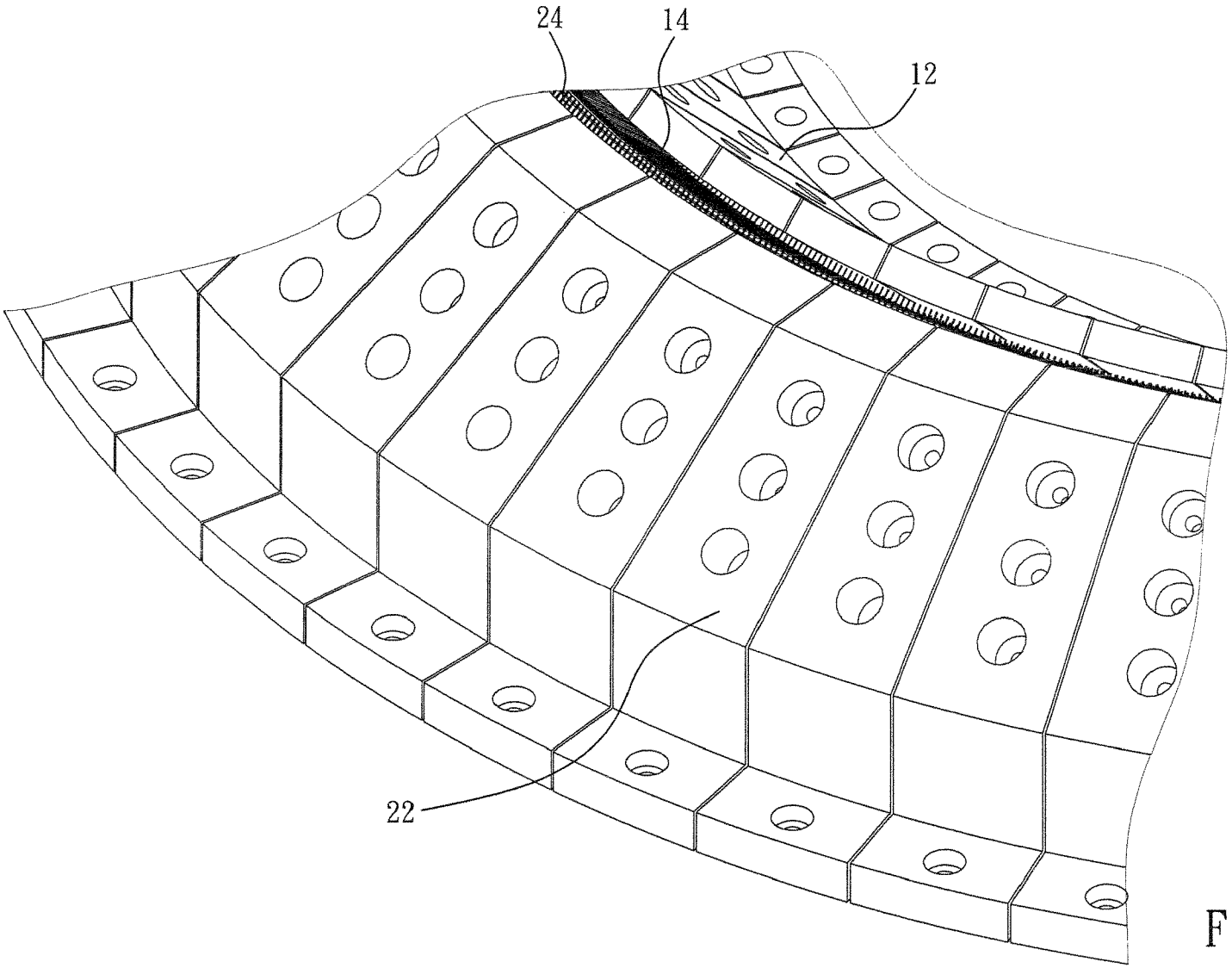
FIG. 2 is an enlarged view of a part of the double bevel type double-knit circular knitting machine in accordance with the present invention.
Figure 3:
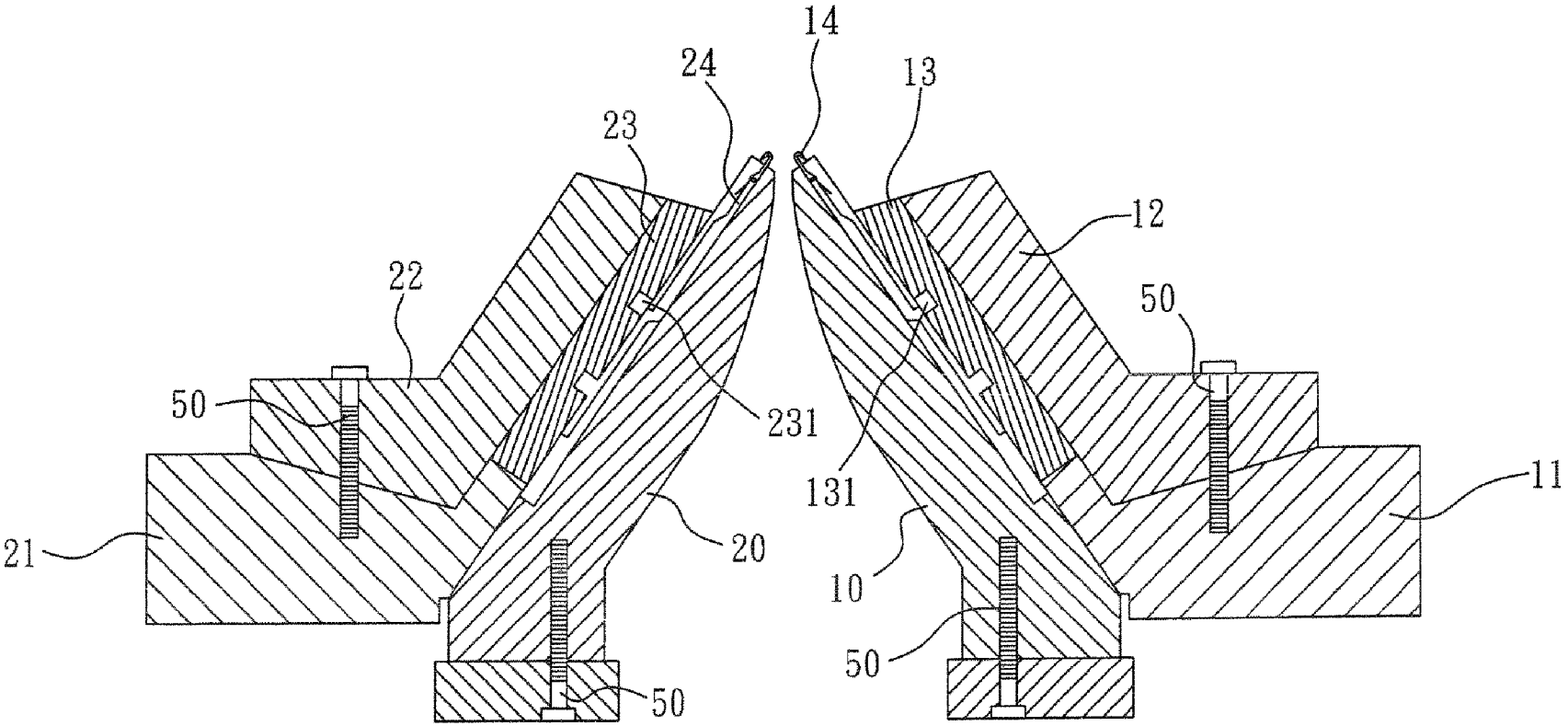
FIG. 3 is a sectional view of the inner annular needle holder and outer annular needle holder of the double bevel type double-knit circular knitting machine in accordance with the present invention.
Figure 4A:
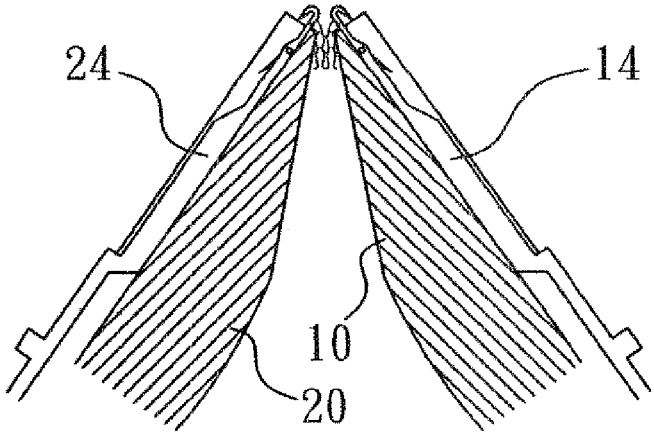
FIGS. 4*a*~4*e* are schematic drawings of the present invention, showing the moving flow of two needles during knitting.
Figure 4B:
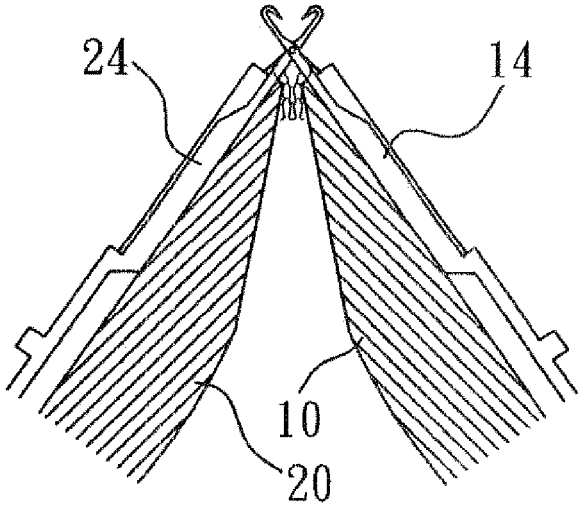
Figure 4C:
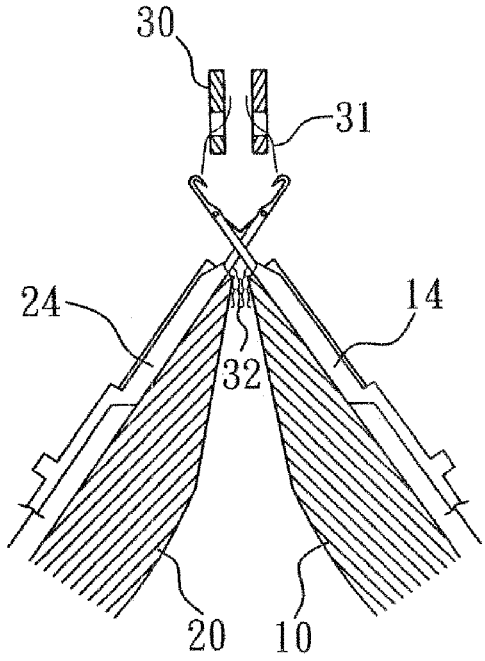
Figure 4D:
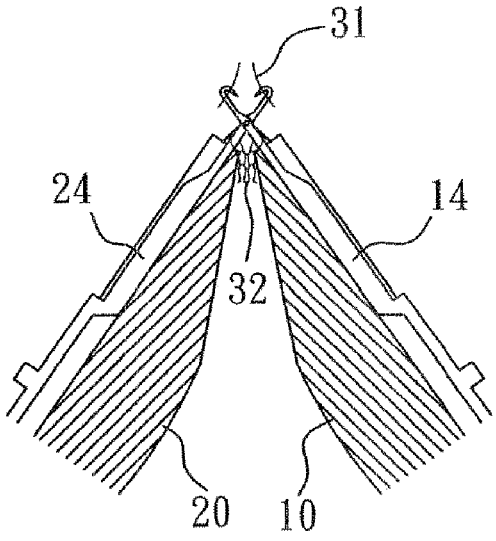
Figure 4E:
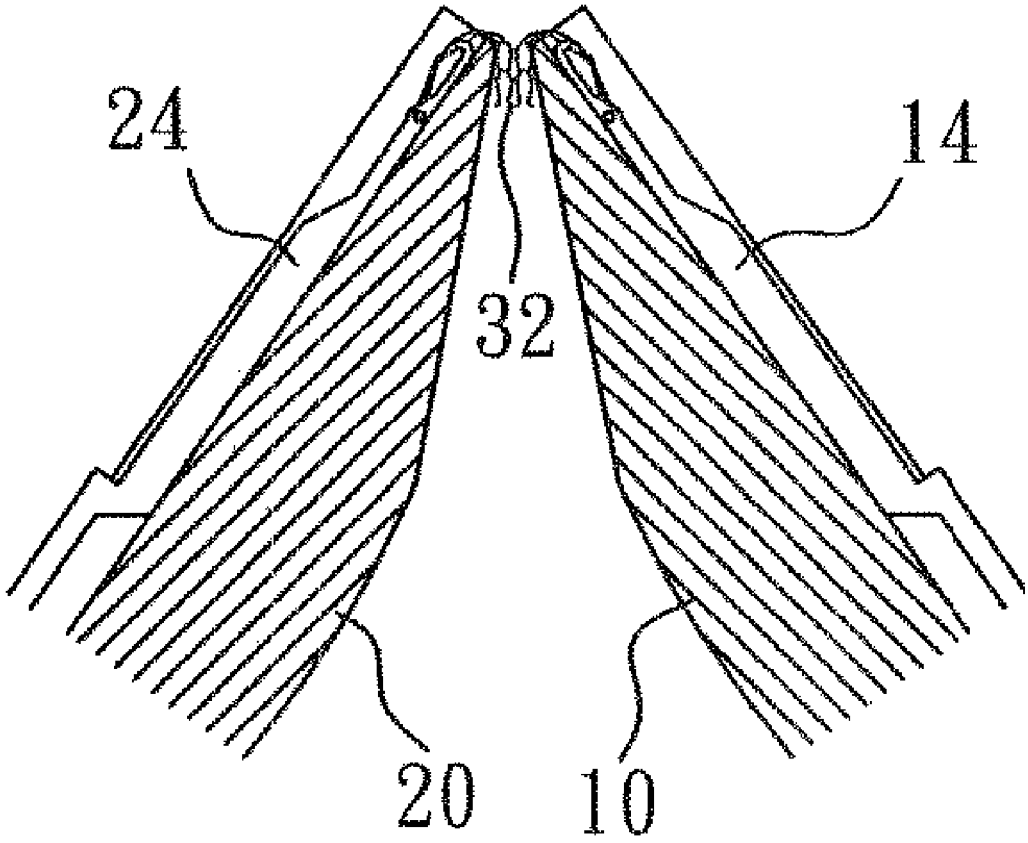
Figure 5A:
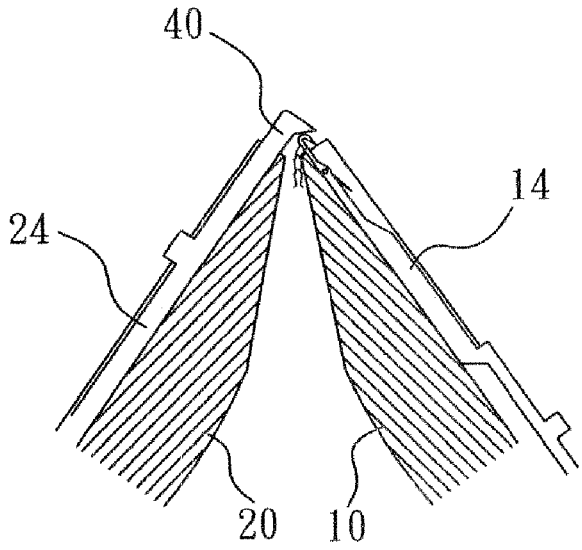
FIGS. 5*a*~5*e* are schematic drawings of the present invention, showing the moving flow of one outer needle and one sinker during knitting.
Figure 5B:
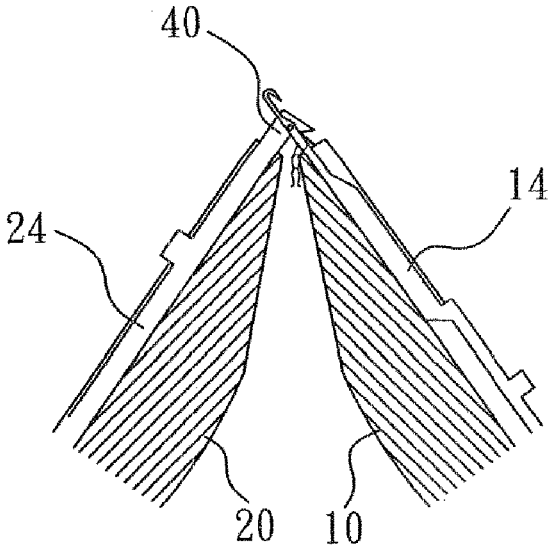
Figure 5C:
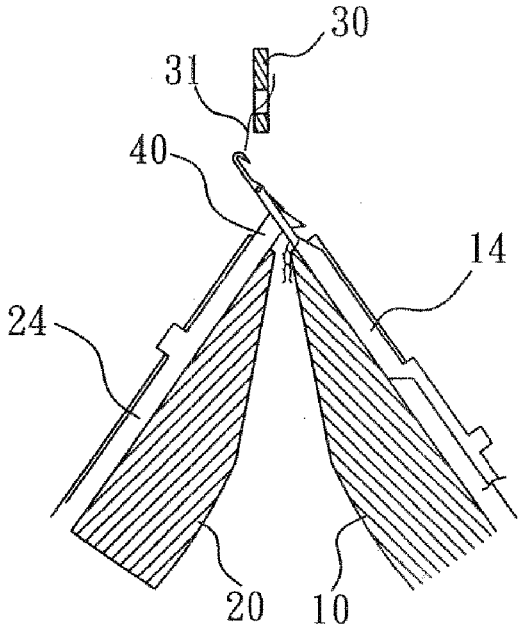
Figure 5D:
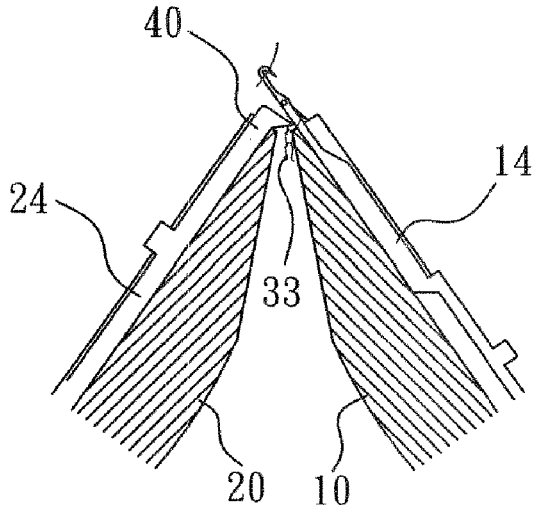
Figure 5E:
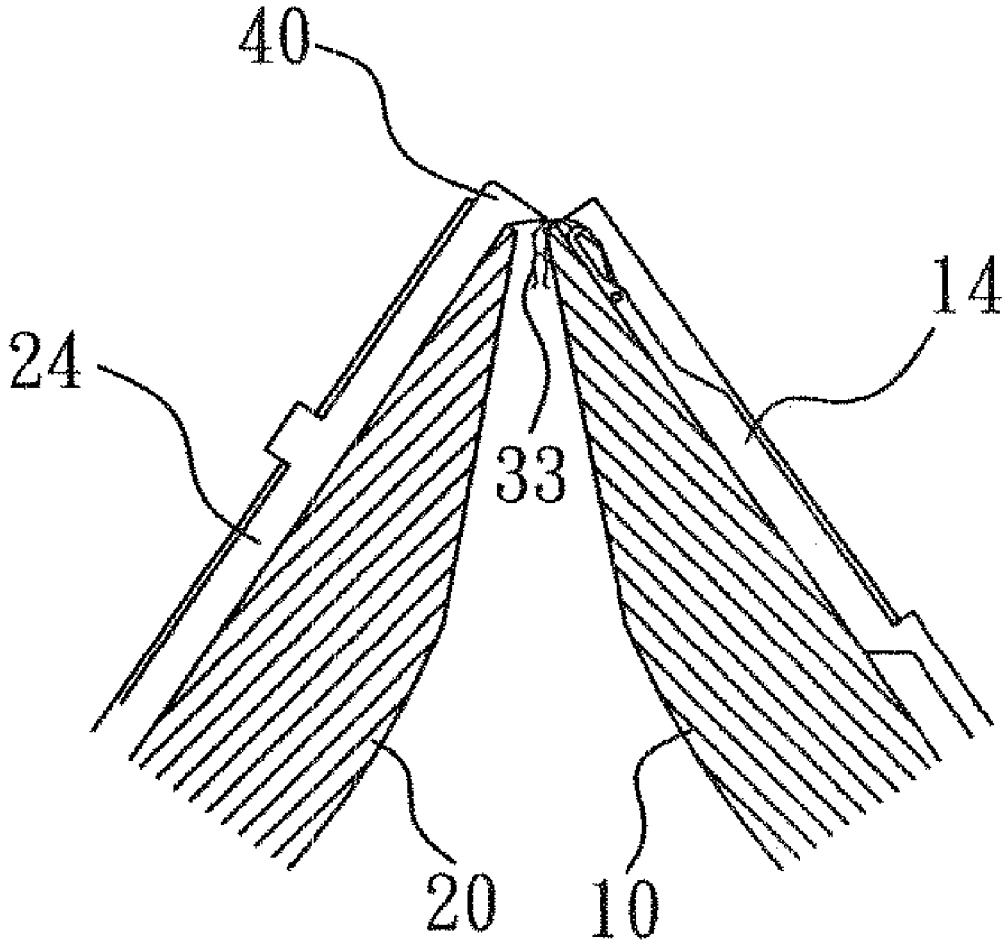
Figure 6A:
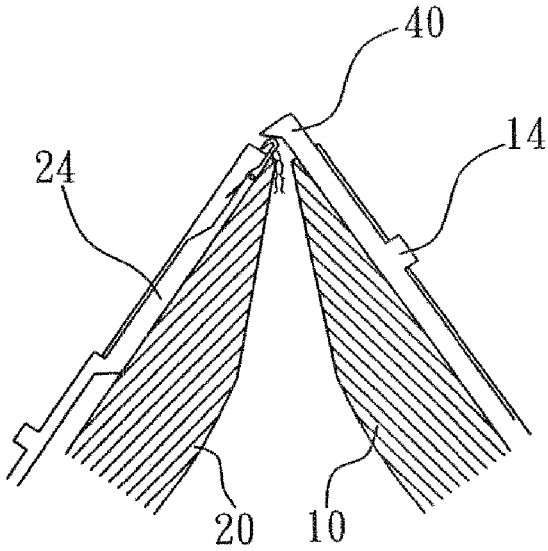
FIGS. 6*a*~6*e* are schematic drawings of the present invention, showing the moving flow of one sinker and one inner needle during knitting.
Figure 6B:
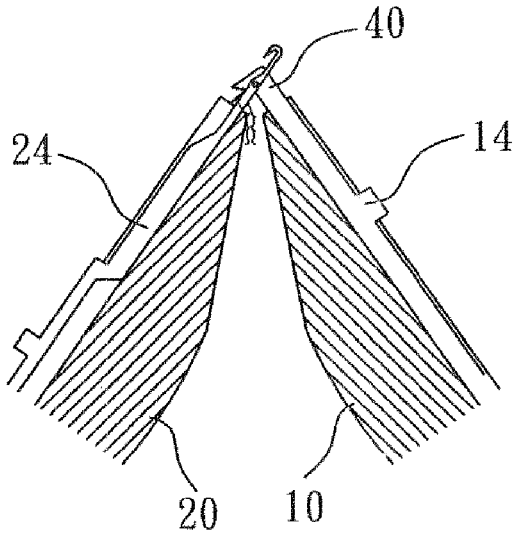
Figure 6C:
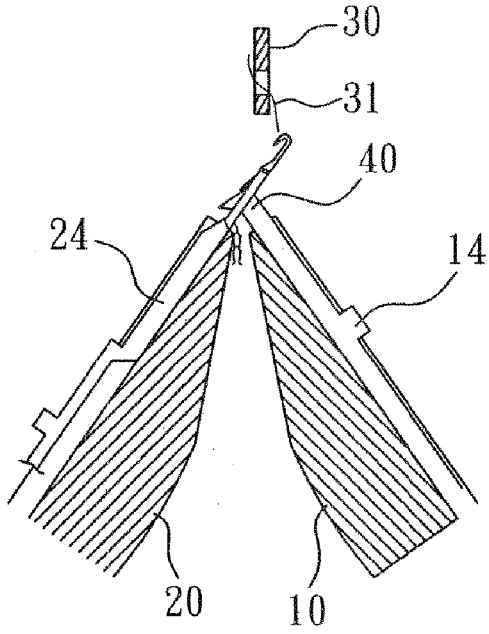
Figure 6D:
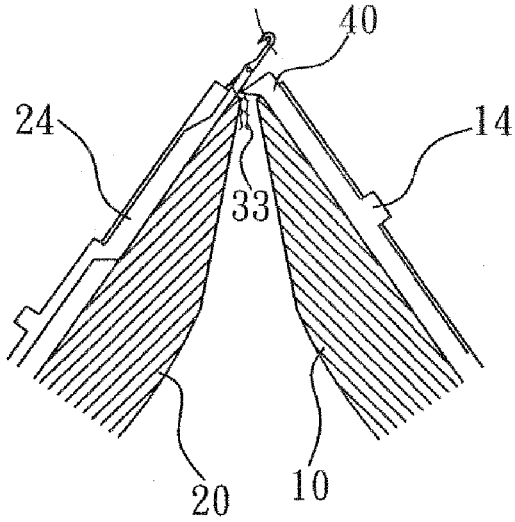
Figure 6E:
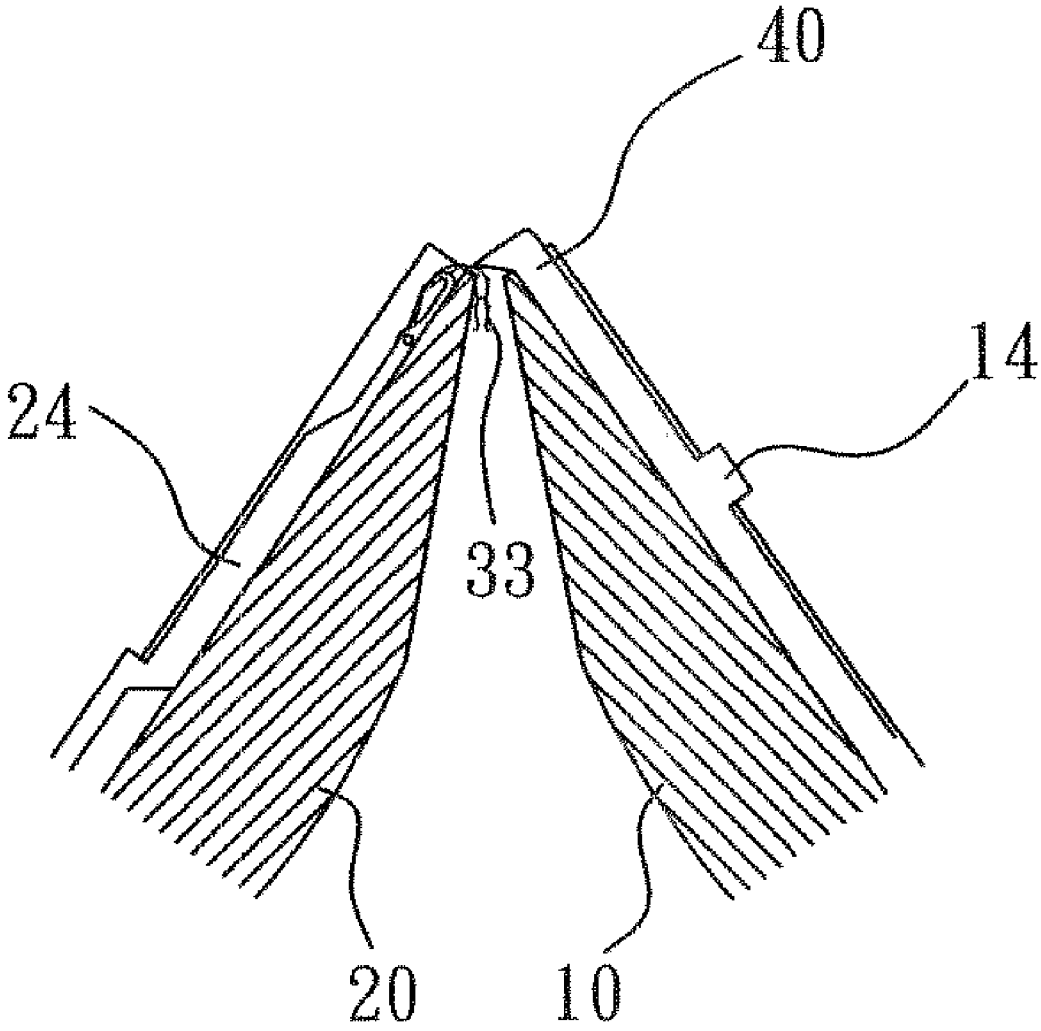

Referring to FIGS. 1~3, a double bevel type double-knit circular knitting machine in accordance with the present invention is shown comprising a disk 1. The disk 1 comprises an inner annular needle cylinder holder 10, and an outer annular needle cylinder holder 20 around the inner annular needle cylinder holder 10. The inner annular needle cylinder holder 10 and the outer annular needle cylinder holder 20 slope in two reversed directions at a same sloping angle to show a double bevel profile. The sloping angle of the double bevel profile is preferably at 50°~60°, most preferably 55°.

The inner annular needle cylinder holder 10 has fixedly mounted on its inner side an inner base member 11. A plurality of sector-shaped inner cam adjustment members 12 are fixedly mounted on the top side of the inner base member 11 and abutted against one another along the inner surface of the inner annular needle cylinder holder 10. An inner cam block 13 is respectively provided at the bottom side of each sector-shaped inner cam adjustment member 12. Multiple inner needles 14 are arranged between the inner annular needle cylinder holder 10 and the inner cam blocks 13. The inner cam blocks 13 each have a predetermined needle track 131. Thee inner needles 14 are reciprocating in the needle tracks 131 of the inner cam blocks 13 to perform the knitting process.

The outer annular needle cylinder holder 20 has fixedly mounted on its outer side an outer base member 21. A plurality of sector-shaped outer cam adjustment members 22 are fixedly mounted on the top side of the outer base member 21 and abutted against one another along the outer surface of the outer annular needle cylinder holder 20. An outer cam block 23 is respectively provided at the bottom side of each sector-shaped outer cam adjustment member 22. Multiple outer needles 24 are arranged between the inner annular needle cylinder holder 10 and the outer cam blocks 23. The outer cam blocks 23 each have a predetermined needle track 231. The outer needles 24 are reciprocating in the needle tracks 231 of the outer cam blocks 23 to perform the knitting process.

The inner annular needle cylinder holder 10 and the outer annular needle cylinder holder 20 are so arranged to show a double bevel profile, and therefore, the sector-shaped inner cam adjustment members 12 and the sector-shaped outer cam adjustment members 22 are arranged in a double bevel manner and sloping at, for example, 55°, the inner needles 14 and the outer needles 24 are also arranged in a double bevel manner and sloping at 55°.

Referring to FIGS. 1~3, the sector-shaped inner cam adjustment members 12 and the sector-shaped outer cam adjustment member 22 are respectively affixed to the inner base member 11 and the outer base member 21 with screws 50. The inner annular needle cylinder holder 10 and the outer annular needle cylinder holder 20 are affixed to the machine base with screws 50.

Referring to FIGS. 4*a*~4*e*, as stated above, the sector-shaped inner cam adjustment members 12 and the sector-shaped outer cam adjustment members 22 are arranged on the disc 1 in a double bevel manner and sloping at 55°, the inner needles 14 and the outer needles 24 are also arranged on the disc 1 in a double bevel manner and sloping at 55°. As stated above the inner needles 14 and the outer needles 24 are symmetrically disposed at two sides and kept at the same sloping angle. This double bevel arrangement facilitates tuck and withdrawal operation of the needles 14 and 24. When compared to conventional double-knit circular knitting machine, the double bevel type double-knit circular knitting machine of the present invention is more compact and light. Further, because the inner needles 14 and the outer needles 24 are respectively arranged in the sector-shaped inner and outer cam adjustment members 12 and 22 in a symmetrical relationship and kept at the same sloping angle, the ribbed structure of the knitted fabric has better elasticity, evenness, tightness, and solidity.

Referring to FIGS. 4*a*~4*e*, during knitting, the inner needles 14 and the outer needles 24 are respectively reciprocating in the needle tracks 131 of the inner cam blocks 13 and the needle tracks 231 of the outer cam blocks 23 subject to a predetermined knitting pattern to knit yarns 31 from a yarn feeder 30 into a knitted fabric 32. Because the procedure of reciprocating the needles 14 and 24 in the needle tracks 131 and 231 of the cam blocks 13 and 23 to knit a knitted fabric 32 is of the known technique, no further detailed description in this regard is necessary.

Referring to FIGS. 5*a*~5*e*, a sinker 40 may be coupled to a predetermined number of outer needles 24 so that the sinker 40 assists in holding down the knitted single knit fabric 33 during knitting.

Referring to FIGS. 6*a*~6*e*, a sinker 40 may be coupled to a predetermined number of inner needles 14 so that the sinker 40 assists holding down the knitted single knit fabric 33 during knitting.

The application of the present invention eliminates the drawbacks of unequal loop lengths or escape of loops that are commonly seen in conventional double knit circular knitting machines, of the type having horizontal needle cylinder holders and vertical needle cylinder holders arranged at right angles, during a knitting action due to the effect of force distribution upon knitting stroke of the needles. Because the invention has the inner annular needle cylinder holder and the outer annular needle cylinder holder be arranged in a double bevel manner at 50°~60°, the inner needles and the outer needles are reciprocating at two sides at the same sloping angle during knitting. Therefore, the invention facilitates tuck and withdrawal operation of the needles to knit a fabric having better elasticity, evenness, tightness, and solidity.

Further, because the inner annular needle cylinder holder and the outer annular needle cylinder holder be arranged in a double bevel manner at 50°~60°, the knitted fabric fall to the bottom side through the gap between the inner annular needle cylinder holder and the outer annular needle cylinder holder, eliminating the drawback of the conventional double knit circular knitting machines in which the sloping face of the vertically extending needle holder hinders curving of the knitted fabric. Further, sinkers may be used and coupled to the inner needles or the outer needles to assist in holding down the knitted fabric, keeping the knitted fabric smooth. Further, the double bevel type double-knit circular knitting machine is practical for knitting double-faced reversible fabrics or double-faced irregular shaped fabrics that are not achievable by conventional double knit circular knitting machines.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A double bevel type double-knit circular knitting machine, comprising:

a disc, said disc comprising an inner annular needle cylinder holder and an outer annular needle cylinder holder extending around said inner annular needle cylinder holder, said inner annular needle cylinder holder and said outer annular needle cylinder holder sloping in two reversed directions at a same sloping angle to show a double bevel profile;

an inner base member fixedly mounted on an inner side of said inner annular needle cylinder holder;

a plurality of sector-shaped inner cam adjustment members fixedly mounted on a top side of said inner base member and abutted against one another along an inner surface of said inner annular needle cylinder holder;

a plurality of inner cam blocks respectively provided at a bottom side of each of said sector-shaped inner cam adjustment members, said inner cam blocks each defining a respective needle track;

a plurality of inner needles respectively arranged between said inner annular needle cylinder holder and said inner cam blocks and reciprocatable in the needle tracks of said inner cam blocks to perform a knitting process;

an outer base member fixedly mounted on an outer side of said outer annular needle cylinder holder;

a plurality of sector-shaped outer cam adjustment members fixedly mounted on a top side of said outer base member and abutted against one another along an outer surface of said outer annular needle cylinder holder;

a plurality of outer cam blocks respectively provided at a bottom side of each of said sector-shaped outer cam adjustment members, said outer cam blocks each defining a respective needle track; and a plurality of outer needles respectively arranged between said outer annular needle cylinder holder and said outer cam blocks and reciprocatable in the needle tracks of said outer cam blocks to perform a knitting process.

2. The double bevel type double-knit circular knitting machine as claimed in claim 1, wherein said sector-shaped outer cam adjustment members are fixedly fastened to the top side of said outer base member with screws.

3. The double bevel type double-knit circular knitting machine as claimed in claim 1, wherein said sector-shaped inner cam adjustment members are fixedly fastened to the top side of said inner base member with screws.

4. The double bevel type double-knit circular knitting machine as claimed in claim 1, wherein said inner annular needle cylinder holder and said outer annular needle cylinder holder are fixedly fastened to a machine base with screws.

5. The double bevel type double-knit circular knitting machine as claimed in claim 1, further comprising at least one sinker coupled to said outer needles for holding down the knitted fabric during knitting of a single knit fabric.

6. The double bevel type double-knit circular knitting machine as claimed in claim 1, further comprising at least one sinker coupled to said inner needles for holding down the knitted fabric during knitting of a single knit fabric.

7. The double bevel type double-knit circular knitting machine as claimed in claim 1, wherein the sloping angle of said inner annular needle cylinder holder and said outer annular needle cylinder holder is 50°~60°.

8. The double bevel type double-knit circular knitting machine as claimed in claim 7, wherein the sloping angle of said inner annular needle cylinder holder and said outer annular needle cylinder holder is 55°.

* * * * *